US009861885B2

(12) United States Patent
Wertz

(10) Patent No.: US 9,861,885 B2
(45) Date of Patent: Jan. 9, 2018

(54) INTERACTIVE GAME WITH INTERCHANGEABLE GAME BOARDS

(71) Applicant: Andrew Wertz, Bryan, TX (US)

(72) Inventor: Andrew Wertz, Bryan, TX (US)

(73) Assignee: Andrew Wertz, Bryan, TX (US)

( * ) Notice: Subject to any disclaimer, the term of this patent is extended or adjusted under 35 U.S.C. 154(b) by 0 days.

(21) Appl. No.: 14/749,121

(22) Filed: Jun. 24, 2015

(65) Prior Publication Data

US 2016/0375351 A1 Dec. 29, 2016

(51) Int. Cl.

| | |
|---|---|
| ***A63F 7/04*** | (2006.01) |
| ***A63F 7/38*** | (2006.01) |
| *A63F 3/00* | (2006.01) |
| *A63F 7/30* | (2006.01) |

(52) U.S. Cl.

CPC ..... *A63F 7/041* (2013.01); *A63F 7/38* (2013.01); *A63F 2003/00347* (2013.01); *A63F 2007/3035* (2013.01); *A63F 2250/48* (2013.01)

(58) Field of Classification Search

CPC ..... A63F 7/3622; A63F 7/386; A63F 7/02; A63F 7/022; A63F 7/041; A63F 7/38; A63F 2007/3035

USPC ..... 273/109–113, 115–117, 441; 446/16, 446/170–172

See application file for complete search history.

(56) References Cited

U.S. PATENT DOCUMENTS

| | | | | | |
|---|---|---|---|---|---|
| 3,643,952 | A * | 2/1972 | Sprowl | A63F 7/386 | 273/110 |
| 4,055,344 | A * | 10/1977 | Soucie | A63F 7/02 | 273/110 |
| 4,166,327 | A * | 9/1979 | Wressell | G09B 19/00 | 273/110 |
| 4,248,427 | A * | 2/1981 | Vierimaa | A63F 7/02 | 273/110 |
| 5,066,014 | A * | 11/1991 | Dobson | A63F 7/386 | 273/108 |
| 5,213,325 | A * | 5/1993 | Malavazos | A63F 7/386 | 273/109 |
| 5,314,367 | A * | 5/1994 | Schaefer | A63F 7/041 | 273/108 |
| 2012/0289349 | A1 * | 11/2012 | Garcia | A63F 7/022 | 463/48 |

* cited by examiner

*Primary Examiner* — Melba Bumgarner
*Assistant Examiner* — Laura L Davison
(74) *Attorney, Agent, or Firm* — Patrick K. Steele

(57) ABSTRACT

An amusement device having a base with a controller, an interchangeable rotatable inclined game board having a plurality of rolling element pathways thereon, and a rolling element that can be introduced onto the interchangeable game board and manipulated by the user through rotation of the controller to move through a plurality of pathways to an exit hole. The exit chute is alignable, by rotation of the game board using the controller, with a gap in a stabilizing ring and an adjacent recess in the base, to enable the gravitationally assisted removal of a rolling element from the play surface to a storage compartment to store the rolling elements that are successfully moved to the exit chute by the user.

5 Claims, 6 Drawing Sheets

INTERACTIVE GAME WITH INTERCHANGEABLE GAME BOARDS

BACKGROUND

Field of the Invention

The present invention relates to a game apparatus. More specifically, the present invention relates to an interactive game having two or more interactive game boards so that one game board can be played, and then the other game board can be quickly and conveniently substituted for the original game board. The same base apparatus can receive and secure a large number of different game boards for varied entertainment using the same game board base.

Background of the Related Art

Interactive games are games in which the user's input changes the outcome of the game and requires frequent user input in response to changes produced by the user's past input. Conventional games can become monotonous to the user due to the same features and same display being seen by the user with every use.

Pinball machines are one type of amusement game apparatus involving static and dynamic displays on a rolling surface that interact with a rolling member introduced onto the rolling surface by the user. However, pinball machines are generally very heavy and non-portable.

Events such as fairs, picnics, festivals, after-school gatherings and the like are often attended by persons, such as children, that would enjoy these types of amusement games but for the difficulty of moving pinball machines to and from the event.

Many games exist and offer no variety in the display or require no varied skills to play. Many games are offered with a permanently connected game board or display that never changes. These kinds of games may quickly become routine and lose their entertainment capacity.

What is needed is an amusement game that conveniently converts from a light-weight and portable configuration to a configuration in which the amusement game can be used and enjoyed during the event, and subsequently conveniently restored to the portable configuration for easy transport back to storage. What is needed is an amusement game that can be easily changed to offer a new display or a new game that requires new skills and offers new challenges to the player.

BRIEF SUMMARY

One embodiment of the apparatus of the present invention provides an interactive game apparatus with interchangeable game boards, comprising a base having a game board receptacle, the base adapted for being supported on a surface, a first game board having an introduction port to receive a rolling element, an exit port through which the rolling element can exit the game board and plurality of pathways thereon through which a rolling element can be guided, and a rotating controller for use by the user in controlling the orientation and rotational speed of the game board to guide the rolling element through the pathways. The apparatus further comprises a second game board having a plurality of pathways thereon, at least one of which leads from an introduction port to an exit port.

One embodiment of the present invention provides a portable amusement game apparatus having a folded configuration for portability and an opened configuration for use and enjoyment. The apparatus comprises a first open channel portion hingedly coupled to a second open channel portion to facilitate the opening and closing of the apparatus. The apparatus of the present invention comprises two 180 degree hinges that provide enhanced structural stability to the apparatus in the open and in the closed and portable configuration.

An embodiment of the present invention provides erectable static and/or erectable dynamic game components on a rolling surface of the apparatus in the open configuration. An embodiment of the present invention with an erectable dynamic game component may further provide a motor connectable to drive the action of the dynamic game component. An embodiment of the present invention with a motor may further provide a battery compartment or retainer to store a battery used to drive the dynamic game component using the motor.

An embodiment of the present invention provides a compartment in which one or more rolling members can be stored and secured in the closed configuration. When in the open configuration, the rolling members are introduced onto a rolling surface within the opened apparatus to interact with the user and the game components on the rolling surface.

DETAILED DESCRIPTION

Figure 1:
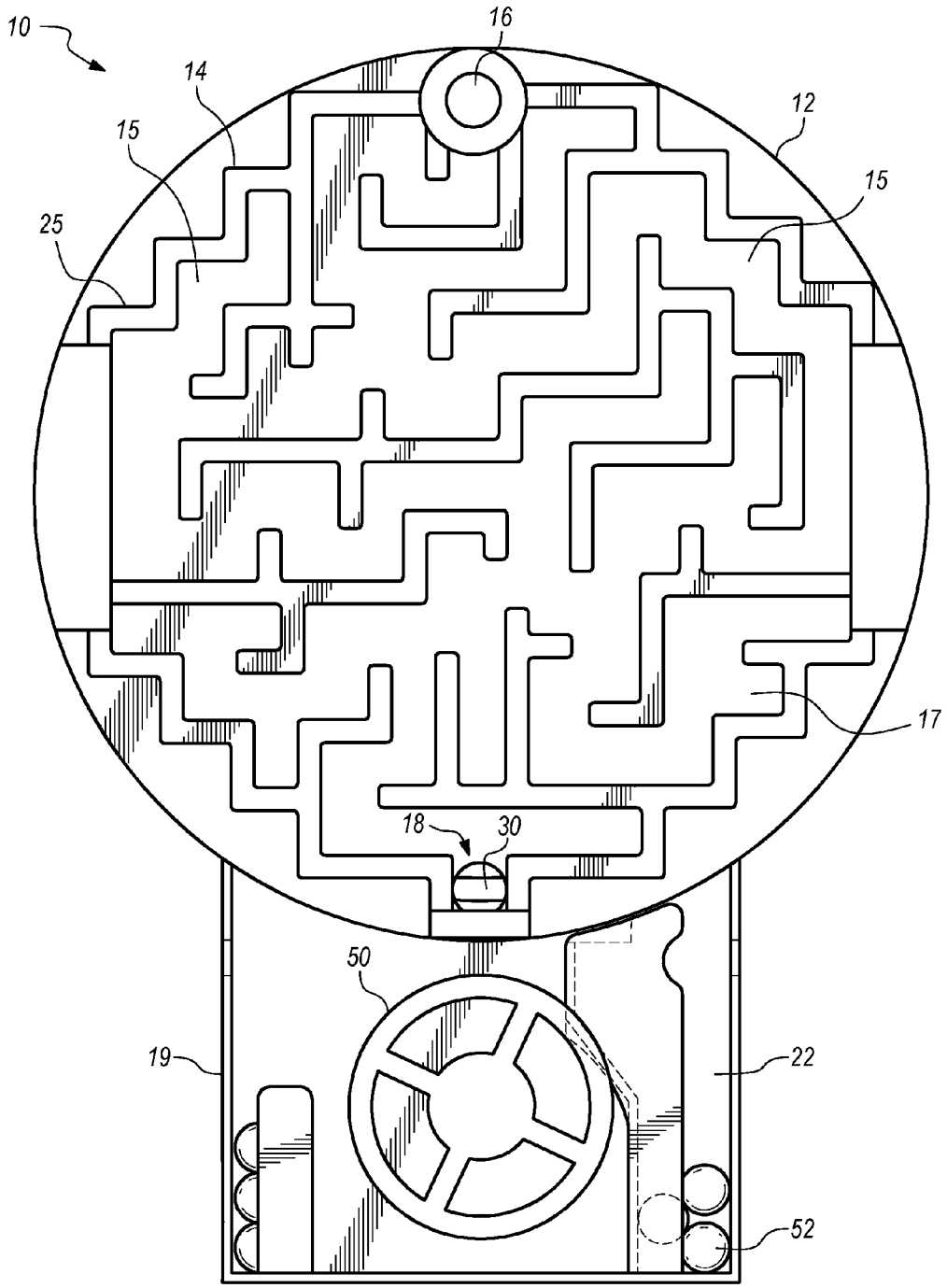
FIG. 1 is a frontal view of the game apparatus having an interchangeable game board received thereon for play.

FIG. 1 is a frontal view of an embodiment of a game apparatus 10 having a base 19 and an interchangeable game board 12 rotatably received thereon for play. A rolling element 52 is initially introduced onto the play surface 17 through the starting gate 16 which, in the embodiment shown in FIG. 1, includes a small cylinder extending perpendicularly from the play surface 17 and having a gate or opening therein through which the rolling element 52 can escape onto the play surface 17 when the game board is properly oriented by the user using the controller 50. The game board 12 includes a plurality of barriers 14 defining a plurality of rolling element pathways 15 on a play surface 17 of the game board 12. The barriers 14 are supported in a spaced-apart configuration from the play surface 17, and the width of the pathways 15 and the spacing between the barriers 14 and the play surface 17 depends on the diameter of the rolling element 52 to be used on the game board 12. The barriers 14 are supported on a plurality of barrier supports 24 (not shown in FIG. 1—see FIGS. 5 and 6). The barriers 14 are of a width and are supported at a spacing from the play surface 17 to prevent the rolling element 52, having a fixed diameter, from engaging the barrier supports 24 as it rolls along a barrier 14. The result is that the rolling element 52 only engages barrier edges 25 as it is manipulated to move through the pathways 15 defined by the barriers 14 on the play surface 17 by changes in the orientation and rate of rotation of the game board 12 by the user. Optionally, the base 19 includes a rolling element accumulator compartment 22 to receive and store rolling elements 52 that have moved through the combination of pathways that lead to the exit chute 18.

Figure 2:
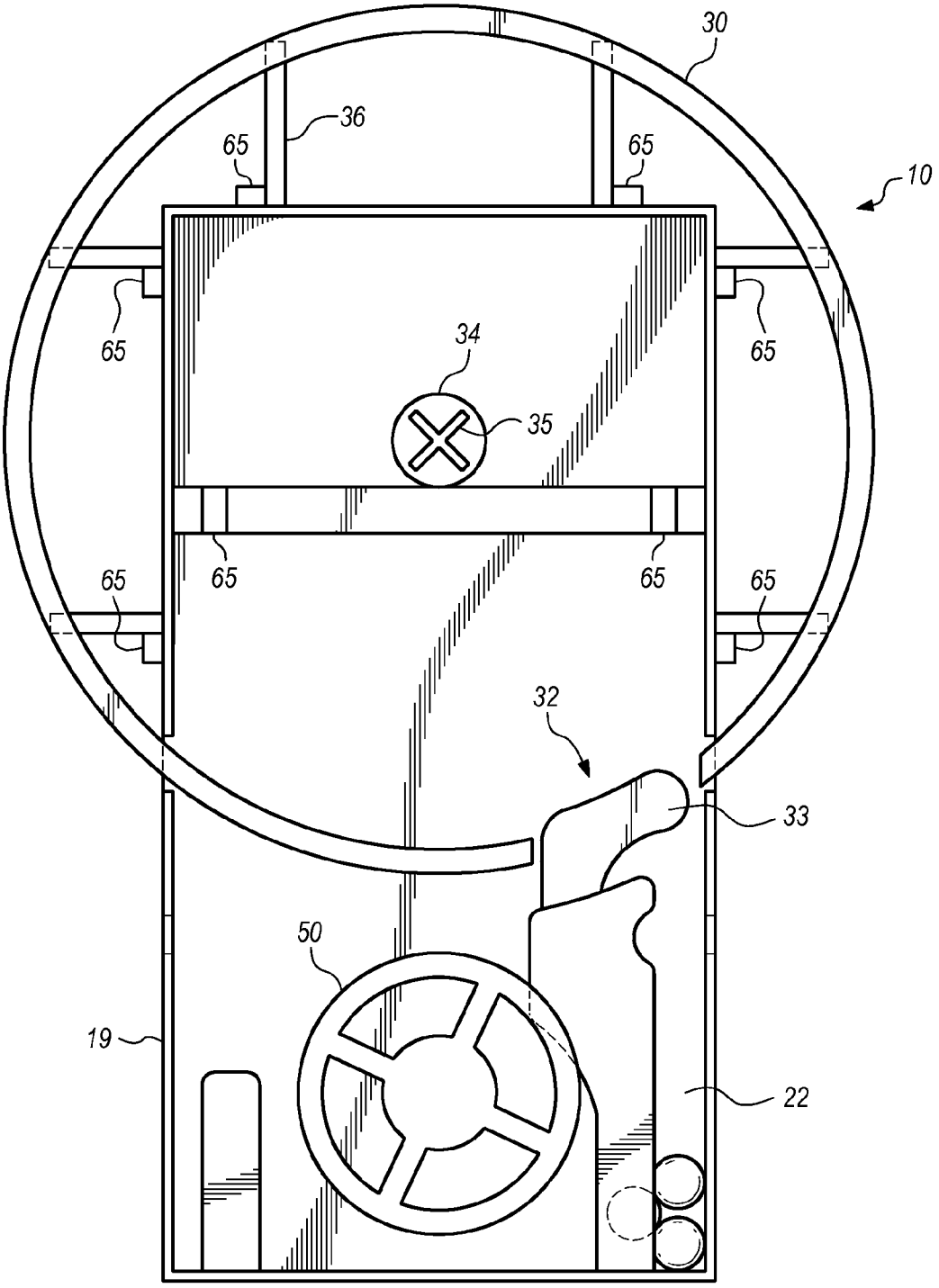
FIG. 2 is a frontal view of the base of the game apparatus with the interchangeable game board removed to reveal a stabilizing ring having a gap adjacent to the exit chute.

FIG. 2 is a frontal view of the base 19 of the game apparatus 10 with the interchangeable game board 12 removed to reveal a stabilizing ring 30 having a gap 32 adjacent to a recess 33, and to reveal a socket 34 having a receptacle 35 to engage a correspondingly formed rotary bit 62 (not seen in FIG. 2—see FIG. 4) on the rear surface 68 of the game board 12. FIG. 2 also reveals a recess 33 in the base 19, the recess 33 adjacent to rolling element accumulator 22. Once the rolling element 52 is received into the exit chute 18 (see FIG. 1) of the play surface 17, the user can use the controller 50 to move the exit chute 18 with the rolling element 52 to a position adjacent to the gap 32 in the stabilizing ring 30. The gap 32 allows the rolling element 52 in the exit chute 18 of the play surface 17 of the game board 12 to be removed from the rear of the play surface 17 by rotating the game board 12 until the exit chute 18 is aligned with and adjacent to the gap 32. FIG. 2 reveals the recess 33 into which the rolling element 52 will roll as it leaves the exit chute 18. FIG. 2 also shows a plurality of support members 65 that one of slidably or rollably engage the rear surface 68 (not shown in FIG. 2—see FIG. 4) of the game board 12. It will be understood that, in one embodiment, the support members 65 may be of a lubricious material and may slidably engage the rear surface 68 of the game board 12 as the game board 12 is rotated by the user's operation of the controller 50. In another embodiment, the support members 65 may comprising a rolling element such as, for example, a wheel or bearing, to engage the rear surface 68 of the game board 12.

Figure 3:
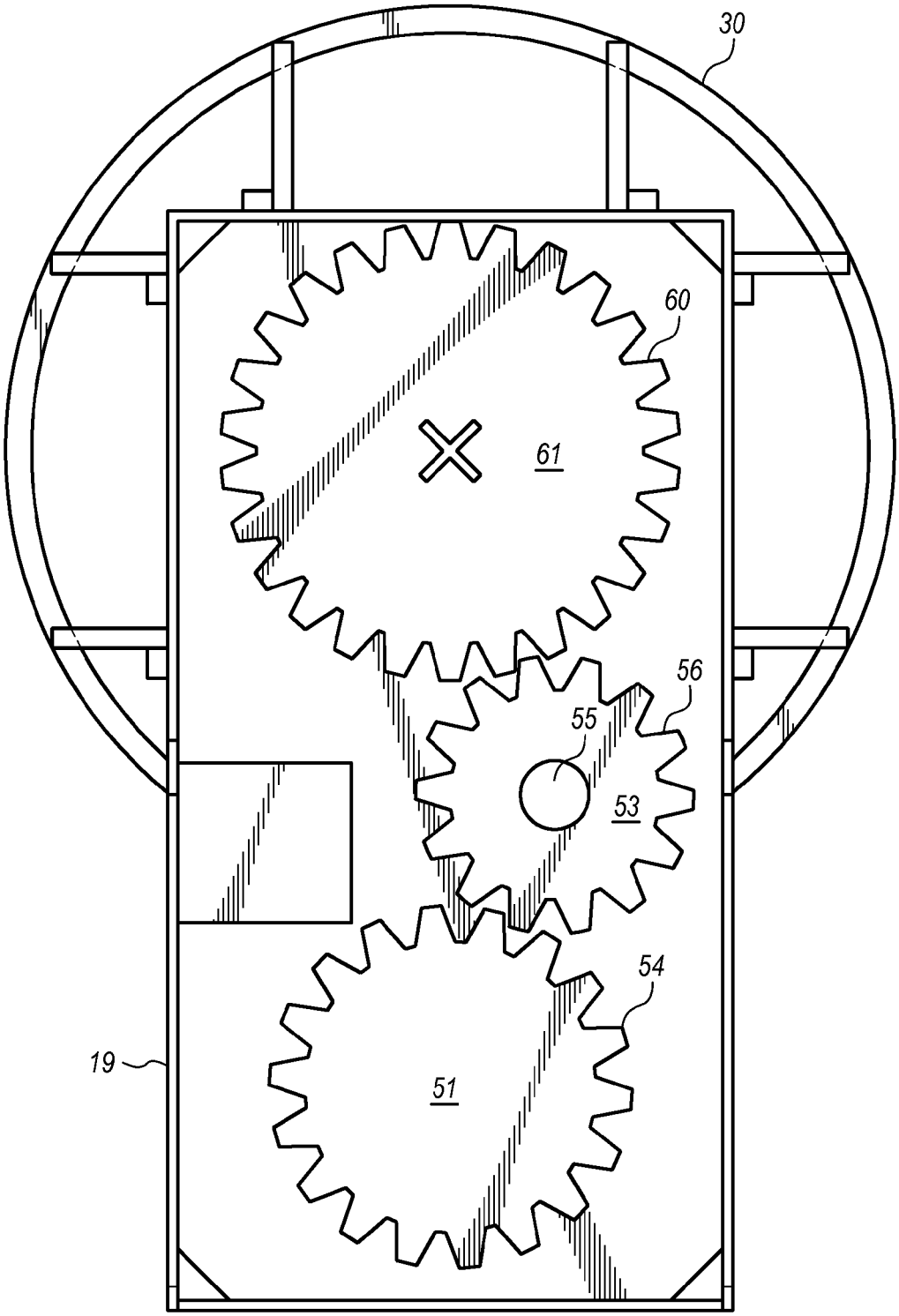
FIG. 3 is a rear view of the base of FIG. 2 showing the gears enabling the controller to control the interchangeable game board (not shown).

FIG. 3 is a rear view of the base 19 of FIG. 2 showing the controller gear 51, rider gear 53 and driven gear 61 together enabling the controller 50 to control the orientation and rate of rotation of the interchangeable game board 12 (not shown in FIG. 3). Controller gear 51 comprises a plurality of teeth 54 and is driven by a controller axle 57 (not shown in FIG. 3) coupled between the controller 50 and the controller gear 51. The rider gear 53 rotates according to the input received from the controller 50 provided by way of the controller gear 51. The rider gear 53 rotates on rider gear axle 55 that is connected to the rear of the base 19. The teeth 54 of the controller gear 51 are sized to engage the teeth 56 of the rider gear 53. It will be understood by those skilled in the mechanical arts that, for each rotation of the controller 50 and the controller gear 51, the rider gear 53 will rotate a multiple of the number of rotations of the controller gear 51 where the multiple is determined by dividing the number of controller gear teeth 54 by the number of rider gear teeth 56.

Similarly, the rider gear teeth 56 engage the driven gear teeth 60 on the driven gear 61. The driven gear 61 is connected to the rear side of the socket 34 which is rotatable within the base 19 and which has a receptacle 35 to engage and receive the rotary bit 62 on the rear surface 68 of the game board 12. It will be understood by those skilled in the mechanical arts that, for each rotation of the rider gear 53 the driven gear 61, and the game board 12 connected thereto, will rotate a multiple that is determined by dividing the number of rider gear teeth 56 by the number of the driven gear teeth 61.

FIG. 3 also shows the stabilizing ring 30 that prevents the rolling element 52 from leaving the play surface 17 by way of the exit chute 18 (not shown on FIG. 3—see FIG. 1) unless the exit chute 18 is aligned with the gap 32 adjacent to the recess 33 (see FIG. 2).

Figure 4:
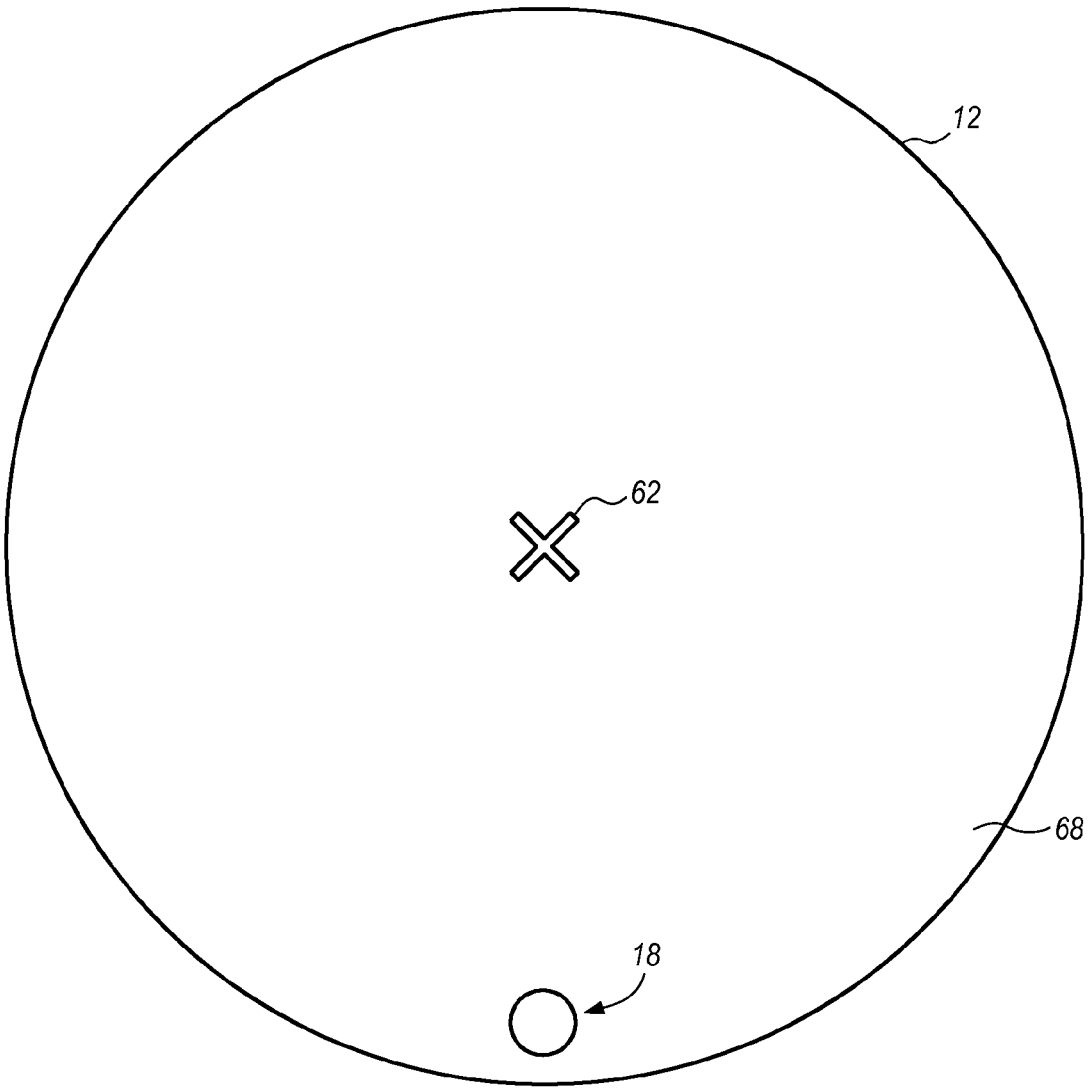
FIG. 4 is rear view of the game board showing the rear surface that is opposite the play surface.

FIG. 4 is rear view of the game board 12 showing the rear surface 68 that is opposite the play surface 17 (not shown). The rear surface 68 includes a rotary bit 62 at the center for being received into the socket 34 shown in FIG. 2.

Figure 5:
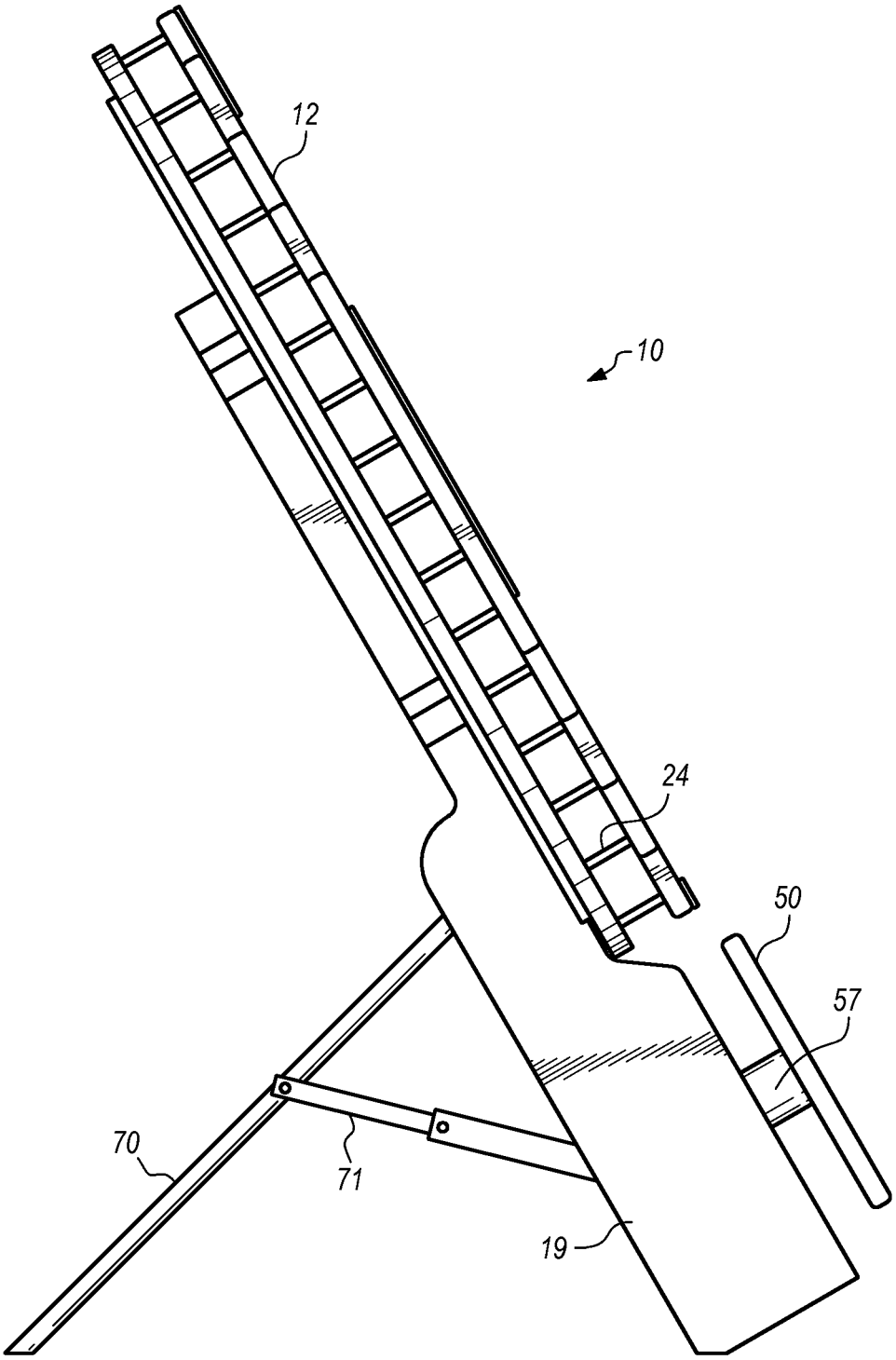
FIG. 5 is a side elevation view of the base of the game apparatus with an interchangeable game board received thereon for play.

FIG. 5 is a side elevation view of the base 19 of the game apparatus 10 with an interchangeable game board 12 received thereon for play. The controller 50 is conveniently positioned for access by a user to control the orientation and rate of rotation of the game board 12. A support member 70 maintains the desired angle of inclination of the base 19. The support member 70 in the embodiment shown in FIG. 5 may be adjustable by extension or contraction of auxiliary support member 71.

Figure 6:
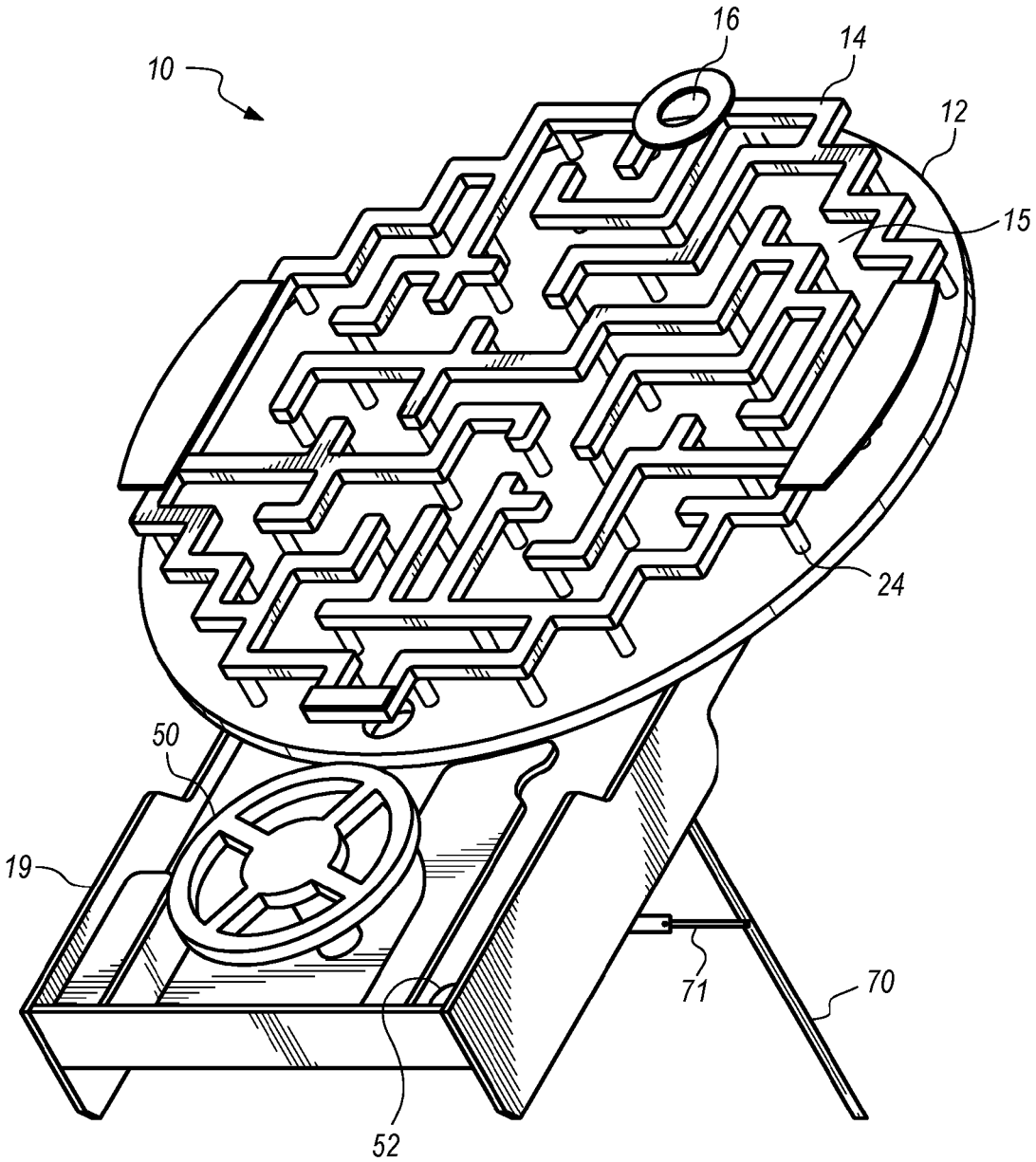
FIG. 6 is a perspective view of the base of the game apparatus and an interchangeable game board received thereon for play.

FIG. 6 is a perspective view of the base of the game apparatus 10 and an interchangeable game board 12 received thereon for play. FIG. 6 better reveals the manner in which the barriers 14 are supported on the game board 12 by the barrier supports 24. It will be understood that the diameter of the rolling element 52 to be used on the game board 12 determines the dimensions of the barriers 14 and the height of the barrier supports 24 in that the barriers 14 are adapted to engage the rolling element 52 without the rolling element 52 contacting the barrier supports 24.

It will be understood that the user can operate the controller 50 in a manner that enables the user to control the movement of the rolling element 52 through a combination of pathways 15 on the game board 12 that will ultimately move the rolling element 52 to the exit chute 32 of the game board 12. The exit chute 32 will retain the rolling element 52 until the user operates the controller 50 to position the exit chute 32 adjacent to the gap 32 in the stabilizing ring 30 to cause the rolling element 52 to roll into the recess 33 and further to the rolling element accumulator 22.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A game apparatus, comprising:

a game board having a play surface and a rear surface, a rotary bit disposed at a center of the rear surface, a plurality of rolling element pathways defined by a plurality of barriers supported on a plurality of barrier supports extending from the play surface, and an exit chute penetrating the play surface;

one or more rolling elements; and a base having a rotary socket to releasably engage the rotary bit on the game board, a recess for receiving a rolling element discharged from the game board through the exit chute, a stabilizing ring surrounding the socket, the stabilizing ring having a radius equal to a distance from the center of the rotary bit to the center of the exit chute and having a gap adjacent to the recess of the base, a controller connected through a controller axle to a controller drive gear, a rider gear engaged to be rotated by rotation of the controller drive gear, and a board gear engaged to be rotated by rotation of the rider gear and connected through a board gear axle to the rotary socket;

wherein rotation of the controller by a user with the game board rotary bit engaged with the rotary socket on the base causes rotation of the game board at a rate of rotation and a direction of rotation that is controllable by the user to control both the orientation of the game board and the rate of rotation of the game board to enable movement of the rolling element through one or more pathways on the play surface;

wherein the stabilizing ring engages and supports the rolling element once the rolling element is received within the exit chute and thereby maintains the rolling element within the exit chute and prevents the rolling element from passing through the gap and from thereby entering the recess until such time that the controller is used to rotate the game board to align the exit chute with the gap in the stabilizing ring that is adjacent to the recess; and wherein rotary alignment of the exit chute with the gap of the stabilizing ring permits the rolling element to pass from, and to roll from the exit chute and to enter the recess.

2. The game apparatus of claim 1, wherein the barriers are of a width and are supported at a spacing from the play surface to prevent the one or more rolling elements from engaging any of the plurality of barrier supports as the rolling element rolls along one of the plurality of rolling element pathways on the play surface of the game board.

3. The game apparatus of claim 1, wherein an angle of inclination of the game board is within the range from 10 degrees from vertical to 40 degrees from vertical.

4. The game apparatus of claim 1, wherein the base further comprises a plurality of support members to one of slidably and rollably engage the rear surface of the game board.

5. The game apparatus of claim 1, further comprising a storage compartment for accumulating rolling elements discharged from the game board through the exit chute and through the gap in the stabilizing ring.

* * * * *